United States Patent [19]

DiMascio et al.

[11] 4,014,146

[45] Mar. 29, 1977

[54] JAMB MOUNTING ASSEMBLY

[76] Inventors: Paul S. DiMascio, R.D. No. 2, Boyertown, Pa. 19512; John D. DiMascio, No. 2 Sylvan Drive, Pottstown, Pa. 19464

[22] Filed: Aug. 28, 1975

[21] Appl. No.: 608,443

[52] U.S. Cl. ..... 52/211; 52/215; 52/217; 52/718

[51] Int. Cl.[2] ..... E06B 1/02

[58] Field of Search ..... 52/213, 214, 215, 217, 52/211, 212, 760, 716; 49/504, 505, DIG. 2

[56] References Cited

UNITED STATES PATENTS

| | | | |
|---|---|---|---|
| 1,049,900 | 1/1913 | Mowins | 52/760 X |
| 1,533,731 | 4/1925 | Foley | 52/760 X |
| 1,621,213 | 3/1927 | Olson | 52/213 |
| 1,926,673 | 9/1933 | Gregg | 52/217 X |
| 2,581,529 | 1/1952 | Hall | 52/760 X |
| 2,582,765 | 1/1952 | Bren | 52/212 |
| 2,721,634 | 10/1955 | Barraco | 49/504 |
| 2,913,777 | 11/1959 | Viets | 52/211 X |
| 3,103,710 | 9/1963 | Fredricksen | 52/211 |
| 3,107,759 | 10/1963 | Day et al. | 52/212 |
| 3,363,392 | 1/1968 | Broughner | 52/217 X |
| 3,401,487 | 9/1968 | Brandt et al. | 52/212 X |
| 3,457,686 | 7/1969 | Henson | 52/213 |
| 3,512,222 | 5/1970 | Tinnerman | 52/760 X |
| 3,614,846 | 10/1971 | Donnelly et al. | 52/213 |
| 3,690,082 | 9/1972 | Byland | 52/213 |
| 3,698,146 | 10/1972 | Brents | 52/217 |
| 3,757,473 | 9/1973 | Mundy | 52/212 X |
| 3,788,019 | 1/1974 | Kielewski | 52/217 X |
| 3,808,759 | 5/1974 | Carmichael | 49/505 |
| 3,884,003 | 5/1975 | Herr et al. | 52/217 X |

FOREIGN PATENTS OR APPLICATIONS

| | | | |
|---|---|---|---|
| 269,451 | 3/1969 | Austria | 49/504 |
| 666,031 | 7/1963 | Canada | 52/716 |
| 1,387,015 | 12/1964 | France | 52/215 |
| 1,216,025 | 5/1966 | Germany | 52/760 |
| 109,126 | 7/1966 | Norway | 49/DIG. 2 |
| 180,024 | 7/1962 | Sweden | 52/211 |
| 476,195 | 9/1969 | Switzerland | 49/504 |

*Primary Examiner*—Leslie Braun
*Attorney, Agent, or Firm*—Woodcock Washburn Kurtz & Mackiewicz

[57] ABSTRACT

An adjustable bracket for mounting a jamb to an adjacent framing member. The mounting assembly comprises at least one L-shaped member, an inner leg of which is secured to the back of the jamb. The outer leg of the member can be nailed to the surrounding framing to locate and support the jamb.

In one embodiment, a pair of telescoping L-shaped members are provided, one of which is secured to the jamb while the other slides within it. The members are advantageously formed with stiffening means at the apexes, and can be formed with detents for engaging the opposite edges of a hollow molding strip.

In another embodiment, the brackets engage one side of the molding strip, the other side thereof being forced into a slot extending along the door jamb. A retainer is described which aids in retaining the molding lip in the jamb slot.

8 Claims, 9 Drawing Figures

JAMB MOUNTING ASSEMBLY

BACKGROUND OF THE INVENTION

The present invention relates to jamb mounting means and more particularly to an improved jamb mount which is adaptable for use with a broad range of jamb and wall thickness.

In the construction of doorways, windows, and other structural openings, it is commonplace to provide a jamb about the inner edge thereof for finishing the otherwise rough edge of the opening and for supporting a door or window therewithin. Although metal and other types of pre-manufactured jambs are in use, the predominant jamb material is wood.

A great deal of the cost in erecting or renovating a structure is, of course, attributable to labor. A substantial portion of the labor is expended in the finishing or "trimming" of the structure. This includes the preparation and installation of various moldings, doors and windows and the aligning and fastening of the jambs which line the openings in the structure. In order to simplify the installation of jambs in structure openings, it has become common for a jamb assembly to be prepackaged in one of several standard sizes. Such assemblies commonly include jambs for the opening and molding which frames the outline of the opening and sometimes include framing members for the opening. However, the procedure for installing the jambs has not changed substantially over the years.

Typically, a structural opening is bounded by framing members such as wooden studs. The installation of such studs ordinarily takes place early in the construction process and without time-consuming measuring, plumbing and trueing operations. Hence, the perimeter of the rough structural opening usually does not comprise a true rectangle, and the sides of the opening are commonly not plumb. Further, the dimensions of the openings vary substantially so that it is rarely possible to attach jambs directly to the framing and provide a serviceable opening which will precisely receive a door or other closure.

In order to produce a properly sized, squared opening such as a doorway, it is therefore necessary to dispose each of the members of the jamb in a proper position with respect to one another, regardless of their relationship to the surrounding framing members. The gaps between the framing members and the jamb are then filled with wooden shims. The shims are usually tapered wooden members, such as wooden shingles, to afford a measure of "adjustability." Individual shims, and combinations thereof, are painstakingly fitted between the framing and the jamb until it is found that the jamb is plumb, and at a predetermined distance from the opposing jamb member. Then nails are driven through the jamb and the shims, into the supporting framing. If all goes well, the nailing does not substantially disturb the placement of the jamb. At this point, protruding pieces of wedge, if any, must be cut off flush with the edge of the jamb. Finally, the surrounding molding must be fitted and nailed to the periphery of the opening.

Numerous efforts have been directed toward the simplification of jamb installation. One mounting means which has been proposed is depicted in U.S. Pat. No. 3,614,846 — Donnelly et al. This mounting bracket comprises a metal strap which is nailed transversely across the back of a door jamb. The strap is perforated in order to weaken it at those points which are expected to correspond with wall thickness; during installation, the ends of the strap are bent at right angles to the jamb so as to lie on either side of the wall which defines the jamb opening. The ends of the strap are then nailed in place and the molding applied thereover in conventional fashion.

While the latter approach constitutes a meritorious attempt to simplify jamb installation, for proper operation the perforated areas of the strap which are to be bent must be accurately aligned with the edge of the wall before fastening the strap to the jamb. A further difficultly is that variations and combinations of construction materials make it difficult to accurately predict just where the strap will have to be bent and used, so that placement of the perforations therein is at best an educated guess. The perforations which are provided to weaken the strap, so that it can easily be bent, also weaken its structure. Such a strap is not suitable for preassembling a jamb within a prefabricated door frame, as it will be bent and distorted during the handling, loading and transportation of the assembly. Finally, the use of such a strap does nothing to assist in placement of the molding about the structure opening. Accordingly, it will be seen that it would be advantageous to provide a jamb mounting assembly which is infinitely adjustable to match any wall or jamb width in a given range, and which assists in the installation of molding.

It is therefore an object of the present invention to provide an improved jamb mounting assembly.

It is also an object to provide an infinitely adjustable jamb mounting adaptable to walls and jambs of many different sizes.

It is another object of the invention to furnish a jamb mounting assembly which forms a support for accurately mounting molding around an opening.

Still another object is to provide a method for preparing a jamb assembly for shipment and installation.

A still further object of the invention is to provide an improved jamb and molding assembly.

SUMMARY OF THE INVENTION

Briefly stated, in accordance with one aspect of the invention, the foregoing objects are achieved by providing L-shaped slide plates and jamb plates. The jamp plates include at least one raised portion which defines apertures for slidingly receiving the slide plate so that a telescoping assembly results. The jamb plate is secured to the back of a jamb so that one leg thereof extends perpendicularly to the jamb, and may be fastened to a surface defining a wall opening. The slide plate is then forced against the opposite side of the wall and fastened in place to complete mounting of the jamb.

In one presently preferred embodiment, the ends of the slide and jamb plates which are fastened against the walls are provided with detents which engage a mating, inwardly turned lip along one edge of a molding. The opposite edge of the molding may be inserted into a preformed slot in the jamb, or may engage a tab extending from the jamb or slide plates.

In another embodiment, the invention is practiced by assembled a preformed, rigid plate to a jamb before the installation thereof. The jamb may be adapted to receive, and used in combination with, a flexible preformed trim element or molding.

BRIEF DESCRIPTION OF THE DRAWINGS

While the specification concludes with claims particularly pointing and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
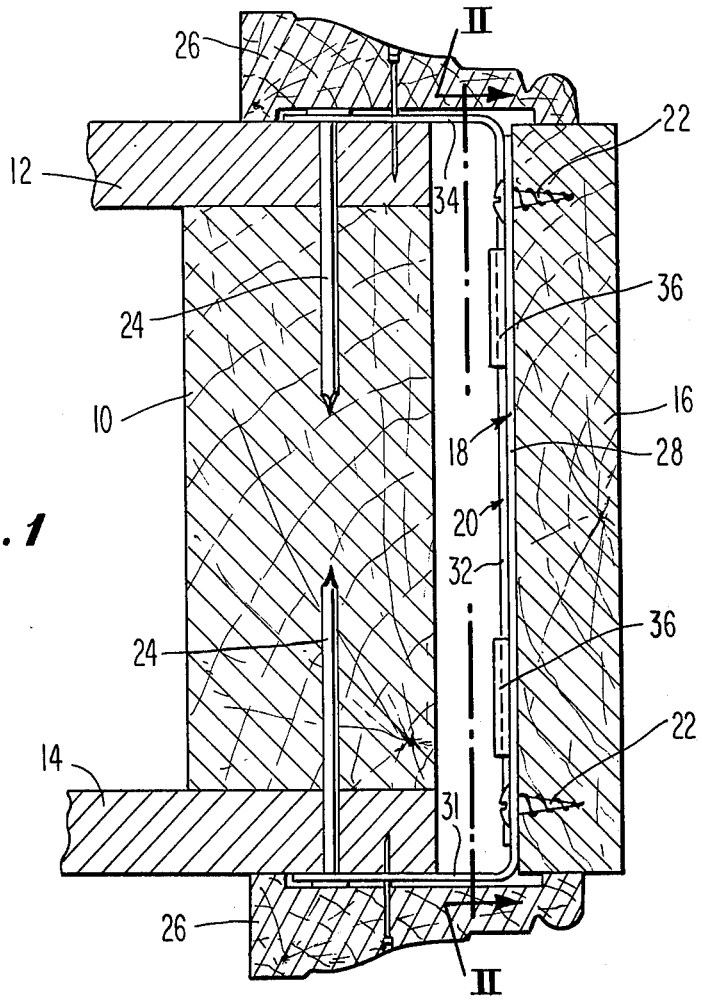
FIG. 1 is a sectional view of a typical jamb construction making use of the present invention.

FIG. 1 illustrates a typical wall construction including a stud 10 and wallboard members 12 and 14 disposed at either side thereof. Stud 10 extends vertically to form one edge of a wall opening, the wallboard terminating approximately flush with the inner edge of the stud. A jamb 16, which may, for instance, comprise a wooden door jamb is disposed some distance away from the stud 10 in order to allow room for trueing the jamb. The jamb is affixed to the adjacent wall structure by means of a jamb mounting assembly which comprises a jamb plate 18 and a slide plate 20. A plurality of fasteners such as screws 22 attach the jamb plate firmly to the back surface of jamb 16. The extremities of the jamb and slide plates are disposed at substantially right angles to the portions thereof which abut jamb 16, and lie upon either side of the wall structure. Nails 24 are driven through the extremities of the slide and jamb plates to secure them tightly to the wall structure. Molding 26 is applied in the usual manner to cover the extending elements of the jamb mounting assembly, and to conceal the gap between the door jamb and wall structure.

Figure 2:
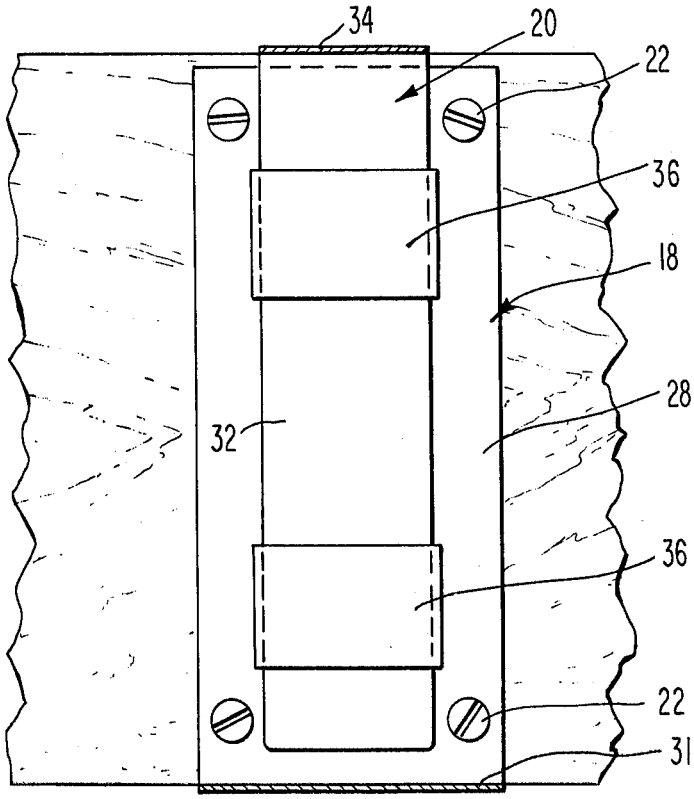
FIG. 2 is a view taken along section II—II of FIG. 1.

Turning now to FIG. 2, the cooperation of jamb plate 18 and slide plate 20 is shown. Slide plate 18 is advantageously formed from metal plate material and bent at right angles to define a first, longer leg 30 and a second, shorter leg 31. In similar fashion, the slide plate is bent to define first and second legs 32 and 34 respectively.

The first leg of the slide plate 18 is provided with a plurality of apertures through which mounting screws 22 may pass. It will readily be recognized by those skilled in the art that other fastening means, such as nails, may be used. It is anticipated that the fastening devices selected will be those appropriate for a particular installation, and are not deemed to comprise a part of the present invention.

A pair of raised elements 36 are struck from the first leg of jamb plate 18. The raised elements are disposed generally transversly to the first leg of the jamb plate and are elevated sufficiently above the upper surface thereof to define an elongate aperture at either side of the raised portion. The first leg 32 of slide plate 20 is slidingly received in the aligned apertures so that the slide and jamb plates telescope together. In this manner the distance between the now-parallel second legs of the slide and jamb plates can be varied to accommodate an infinite variety of wall dimensions, within the dimensional capability of the assembly.

Figure 3:
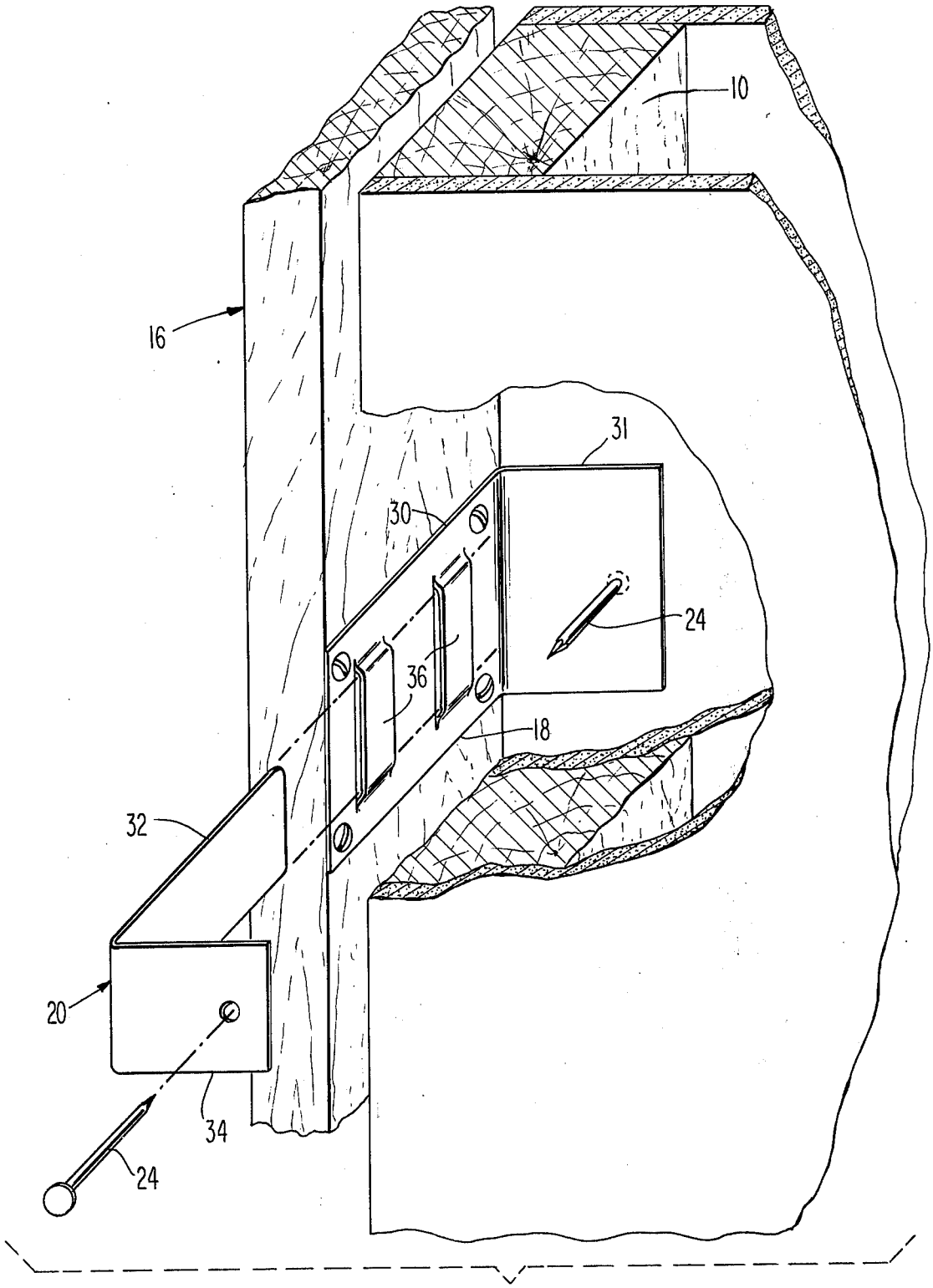
FIG. 3 is an exploded isometric view of jamb construction showing one embodiment of the invention.

Turning now to FIG. 3, the manner of installation of the jamb plate assembly is depicted. In use the first longer leg 30 of jamb plate 18 is fastened to a jamb 16 so that the second, shorter leg 31 thereof is aligned with the edge of the jamb. It is expected that at least two or three jamb plates will be used to secure the jamb to the adjacent wall structure, depending upon the size of the structure involved. The jamb is then assembled within the rough opening so that the second leg 31 of jamb plate 18 lies flush against the rearward base of the wall structure. Jamb 16 is then positioned and plumbed as required, and nails 24 driven through the second legs of the jamb plates to fasten the jamb to the adjacent wall in the desired position.

At this point, slide plate 20 may be assembled to the jamb plate by sliding the elongate, first leg 32 of the slide plate into the cooperating apertures which are defined by raised portions 36 of the jamb plate. The second leg 34 of slide 20 is forced against the near side of the wall, and another nail 24 used to fasten the slide plate securely to the wall structure.

It can now be seen that although the slide and jamb plates are only slidingly engaged when the second legs thereof are fastened to the wall structure, jamb 16 is rigidly supported. The support which is thus provided has been found to be extremely sturdy, and avoids the need for driving nails into the exposed face of the jamb in order to secure the jamb to the wall structure. Should it be necessary to remove the jamb for realignment or other modification, this can be achieved by removing nails 24, without any damage whatever to the jamb itself. A molding may be disposed along the juxtaposed edges of jamb 16 and the neighboring wall structure in order to conceal the gap therebetween, and in the process to conceal the opposed legs of the jamb and slide plates.

In many cases, it will be unnecessary to assemble a slide plate to each one of the jamb plates. It has been determined that in some instances a single jamb and slide plate assembly disposed near the lower end of each vertical jamb, in concert with several lone jamb plates at other, higher points on the jamb, provides adequate support for the jamb structure.

Figure 4:
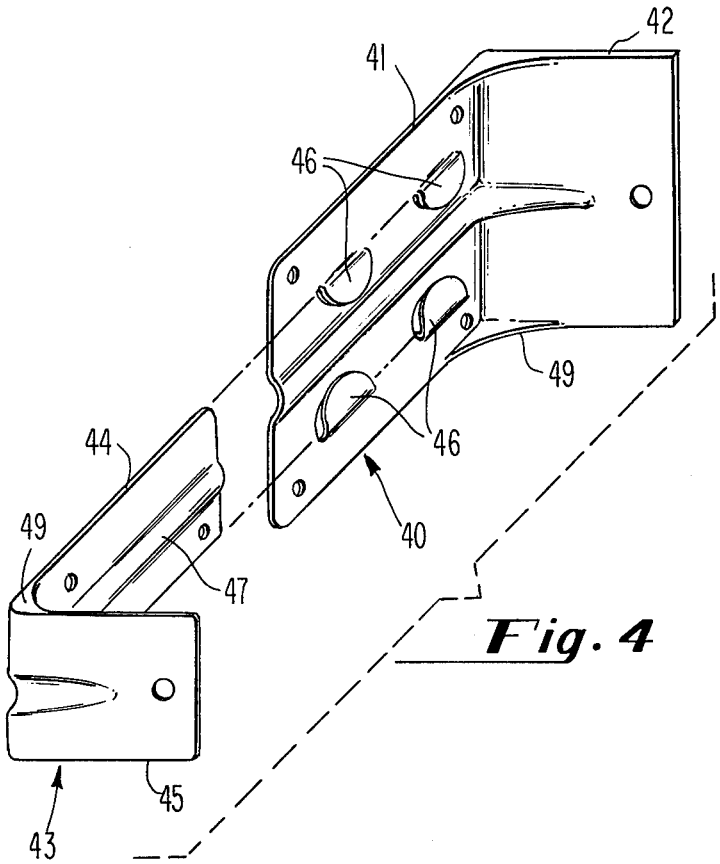
FIG. 4 is an isometric view of another embodiment of the invention.

FIG. 4 shows another embodiment of cooperating slide and jamb plates. As before, a jamb plate 40 is provided and comprises an elongate first leg 41 and shorter leg 42, the legs being at substantially right angles to one another. Slide plates 43, also comprised of a long leg 44 and short leg 45, is adapted to be slidingly received in jamb plate 40.

In order to receive and retain the slide plate 43, a plurality of opposed retainer members 46 are disposed upon the jamb plate. Members 46 advantageously comprise tabs which are partially severed from the jamb plate material and then deformed so as to extend parallel to, and space from, the surface of the jamb plate.

It will be recognized by those skilled in the art that retainer members 46 may alternatively be formed separately and then attached to the material of jamb plate 40 by an appropriate method such as welding or brazing. Additionally, it should be apparent that although the retaining members are shown disposed directly opposite one another, they may alternatively be staggered or placed in any appropriate array. The exact disposition of the retainer members is not critical, it only being necessary that they receive opposite sides of the second leg 44 of the slide plate so as to restrict movement of the slide plate to translation parallel to the second leg of the jamb plate.

In order to allow the slide and jamb plates to be manufactured from relatively light material yet provide the requisite strength and rigidity, stiffening means may be provided. Such stiffening may take the form of veins 47 which are formed in the slide and jamb plates. The veins illustrated comprise ridges pressed from the otherwise-flat material of the plates. The veins extend about the apexes of the L-shaped plates in order to firmly maintain the first and second legs in predetermined angular relationship to one another. In addition, by extending the veins 47 along the mating surfaces of the jamb and slide plates, an additional locating means is formed which aids in the registry of the plates.

Alternatively, or in addition to, veins 47 reinforcement about the apex of either or both jamb and slide plates may be afforded by means of flanges 49. The flanges are advantageously formed at the edges of the plates, and extend about the apexes thereof in the manner depicted to rigidly support one leg with respect to the other. In the foregoing manner, the L-shaped of the plate is rigidly maintained and distortion of the plates due to impacts incurred during handling, transportation or the like is resisted.

The slide and jamb plates of FIG. 4 may be installed in the same manner as was described with respect to the embodiment of FIG. 3. Jamb plate 40 is initially fastened to the rear surface of a jamb member 16, then the jamb is aligned and the second leg 42 of the jamb plate is nailed to an appropriate framing member. The presence of the stiffening means at or about the apex of the jamb plate has been found not to hinder the installation of the jamb and plate since the jamb is ordinarily spaced far enough from the edge of the opening to allow the wall surface to clear the raised, stiffening members. However, with most types of building construction, the wall material is deformable such that upon interference with the stiffening means of the jamb plate, it will "crush" adequately to receive the stiffening means and allow the second leg of the jamb plate to be brought flush against the wall surface.

With the present invention, there is then provided a rigid L-shaped plate which may be attached to a jamb at the point of manufacture, the plate being sufficiently rugged to withstand impact and stress occurring during shipment and handling of the assembly. The invention is particularly useful where it is desired to manufacture and ship pre-assembled door jamb and frame assemblies. Traditionally, a door frame assembly has been constructed and a finished jamb and door mounted therein to form a completed assembly. The jamb members are attached to the framing members in accordance with traditional practice, a door is mountd, and the finished assembly packed and shipped to a distant site for installation.

Unless the assembly is solidly constructed, it will flex and deform and made proper operation of the door impossible. With the means taught by the instant invention, the alignment and assembly of jambs and frames is simplified, and speeded considerably. Further, the jambs are strongly supported within the surrounding framing, and resist dislodgement or distortion during rough handling. If jambs are shipped without the surrounding frame, but with the illustrated plates attached, the plates will still resist bending and other distortion due to their rigid nature.

As set forth above, in instances where it is through unnecessary to secure a jamb by means of both a slide and jamb plate, only one such L-shaped bracket is needed. In such instances, it may be feasible to fasten one or more slide plates directly to the rear surface of the jamb. Nonetheless, it is anticipated that for any installation at least two jamb plates must be provided for receiving slide plates and ultimately securing the jamb to both sides of a surrounding wall structure.

Figure 5:
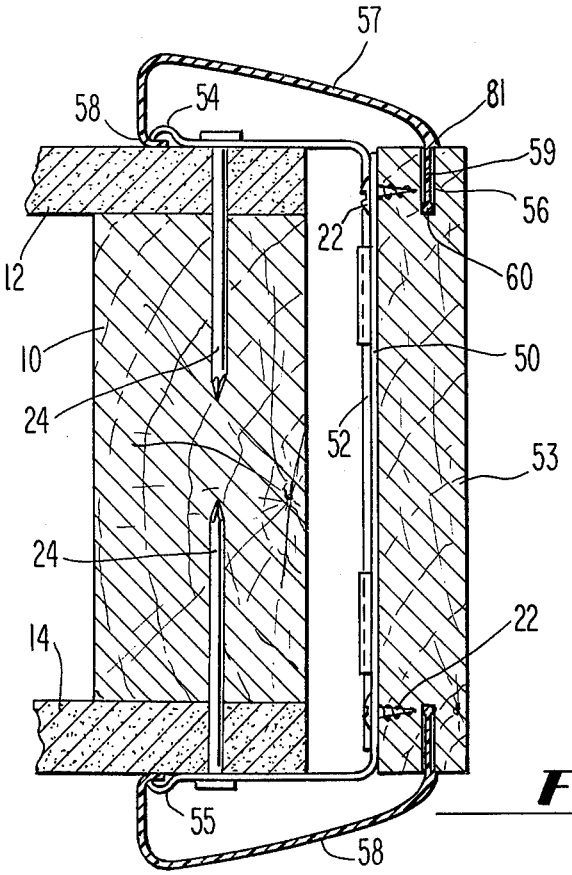
FIG. 5 is a sectional view showing an assembly including molding.

Referring now to FIG. 5, there is shown a cross-sectional view of an associated wall and jamb using a modified embodiment of the mouting assembly shown in FIGS. 1–4. A jamb plate 50 and slide plate 52 are provided, the telescoping portions thereof being similar in nature to those depicted in FIGS. 1–4. The first leg of jamb plate 50 is securely fastened to jamb 53 by means of screws 22.

As before, the wall structure is formed of an upright stud 10 and adjacent wall surfaces 12 and 14, which may, for example, comprise sheet rock or plasterboard. Also, as previously described, nails 24 are used to fasten the opposing, second legs of the slide and jamb plates against opposing wall surfaces.

At the end of the second, shorter leg of slide plate 52 is a detent 54, herein illustrated as a turned-in flange. A similar detent 55 is formed at the end of the second leg of jamb plate 50. The ends of the detents are advantageously spaced slightly from the plane of the wall for purposes to be explained hereinafter.

The edges of jamb 53 are provided with slots 56 which extend the length of the jamb for receiving one end of a molding 57 in the manner shown. Molding 57 is formed from an appropriate material such as metal or plastic, and is sufficiently flexible to allow it to be deformed during installation or removal.

One edge of molding 57 is turned under to form a first lip 58. The opposite edge of the molding comprises a second lip 59 which extends at approximately right angles to lip 58. The second lip is provided with a protrusion such as bulbous ridge 60 which fits tightly into slot 56 and bears against the opposite walls of the slot to secure the molding in place. An abutment 81 which extends along the second lip limits the penetration of the lip into slot 56 so as to present a consistent appearance despite variations in the depth of the slot.

The installation of molding 57 is straightforward. Second lip 59 is pushed into slot 56 until the abutment 60 is brought flush with the surface of jamb 16. The opposing edge of the molding is then forced toward the wall surface such that first lip 58 is forced outwardly to the edge of detent 54. Lip 58 then rides over the edge of detent 54, snapping inwardly and beneath the detent to assume the position shown in FIG. 5.

In installations where only a few jamb plate assemblies are used, it may be found desirable to install additional mounting clips for supporting molding 57 along its length. For present purposes, these mounting clips may be thought of as comprising the severed second leg portions of the slide or jamb plates. The clips are nailed at appropriate positions along the wall surface to provide the additional detents needed. Further, it may be found desirable (depending on the characteristics and configuration of the second lip 56 of the molding and the slot provided in the jamb 53) to provide additional means for securing the molding lip to the jamb.

Figure 6:
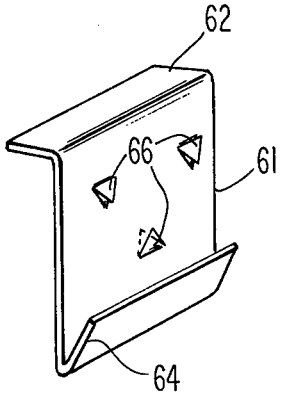
FIG. 6 is a retainer clip used with the embodiment of FIG. 5.

FIG. 6 illustrates a clip which may form a portion of the last-designated embodiment. The clip includes a central portion 61 and upper and lower portions 62 and 64 respectively. The lower end 64 is bent at an acute angle to center section 61, while the upper end 62 is bent at substantially right angles thereto to form a flange which is easily manipulated to force the retention clip into a receiving slot in a jamb. A plurality of upstanding teeth 66 are struck from the central portion of the retention clip, which is advantageously formed of resilient sheet metal. In a preferred embodiment, teeth are struck from both sides of the retention clips so that they securely grip the material of both the jamb and the molding.

Figure 7:
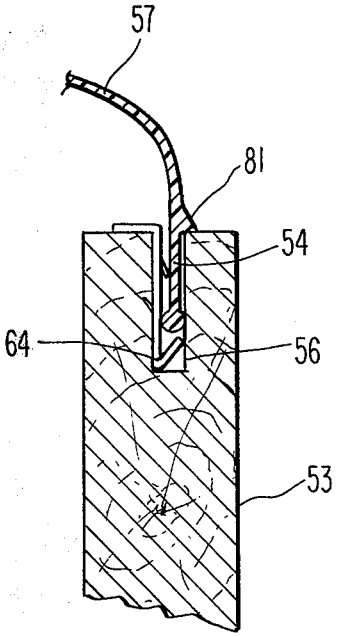
FIG. 7 shows the placement of the clip of FIG. 6.

FIG. 7 shows the retention clip in place within a slot formed in the wedge of jamb 53. It will be seen that the lowermost portion of the clip 64 extends across the width of slot 56 to engage the opposing side thereof, holding the clip formly in place after it has been inserted in the slot. Upon inserting lip 59 of molding 57, it will be seen that one of the teeth 66 of the retention clip engage the molding clip and prevent its withdrawal from slot 56.

Figure 8:
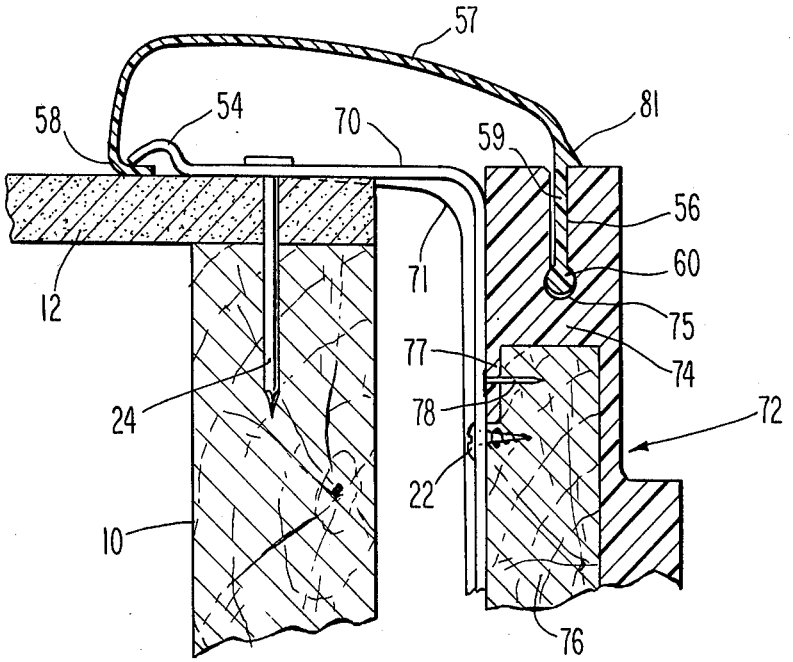
FIG. 8 is a cross sectional view of another embodiment of a jamb and molding system.

FIG. 8 illustrated a jamb and trim system which incorporates a rigid L-shaped bracket to afford the facile installation of the system. As in FIG. 5, molding 57 is provided with a first, inwardly turned lip 58 which is resiliently received beneath a detent 54. The detent is formed upon an extremity of the shorter leg of an L-shaped slide plate 70, which also includes stiffening means 71 extending about the apex thereof. In the illustrated embodiment, the stiffening means comprises a vein which extends axially along the longer leg of the bracket, as in the embodiment depicted in FIG. 4. The jamb plate is fastened against a wall section 12 and supporting stud 10 by means of a nail 24, and is firmly fastened to the back of a jamb 72 by appropriate fastening means such as screw 22.

The construction of jamb 72 is of particular interest. The jamb comprises an outer sheath 74 formed of a flexible, readily extrudable material such as vinyl plastic. An elongate slot 56 is formed in the sheath as it is extruded, and advantageously includes an enlargement or cavity 75 at its inner end. The cavity is large enough to retain the bulbous end 60 of molding 57, the molding also being provided with an abutment 81 which aids in maintaining the molding in firmly abutting relationship with the jamb.

Due to the resilient nature of the jamb sheath, the bulbous end 60 of molding 57 may be forced into the slot by the application of moderate pressure to the outer surface of the molding. Unlike a slot formed in a wooden jamb, the walls of the illustrated slot can be forced apart due to the resilient nature of the material from which the sheet is made. Further, if the walls of the slot are provided with a relatively smooth surface friction between the bulbous end 60 and slot size is minimized to further enhance the ease of assembly of the system.

When bulbous member 60 reaches the cavity 75 formed in the bottom of the slot the walls of the slot spring back into place, encapturing the bulbous member therewithin and resisting the withdrawal of the molding lip from the jamb. In this manner, the associated bulbous end 60 and cavity 75 provide a detent which locks the molding in place.

In order to form a strong, rigid jamb sheath 74 is formed about a supporting core 76. While extruded jambs, as such, are known in the art such jambs are conventionally formed in a hollow configuration, such as a channel. In order to provide sufficient strength to the jamb member without utilizing an inordinate amount of plastic material, the jambs are usually provided with a plurality of ridges or convolutions to add strength and longitudinal rigidity to the structure. However, the present invention contemplates that the sheath may be formed in an aesthetically pleasing configuration and rely for structural support on an inner member of a strong, inexpensive material such as wood. The wooden support member 76 is provided with a relief along the edges thereof for receiving a flange 77, which comprises an integral portion of the molded sheath. Due to the resilient nature of the sheath material the flange may be easily deflected outwardly so that core 76 can be inserted thereunder. Preferably, a fastener such as nail 78 is used to secure the flange in place. By it relieving the back surface of core 76 a flat, continuous surface is provided across the back of the composite jamb to afford a flat surface against which jamb plate 70 may bear. It should of course be realized that various other constructions are possible, the one illustrated representing only a presently preferred embodiment. It may, for instance, be feasible to extrude sheath 74 over lengths of core material, or to form the sheath in other ways to engage the core member. Further, it may be desirable to form the core of materials such as composition board, etc. which can be inexpensively manufactured. Since the core is not visible, being encased by sheath 74, its appearance is of no consequence and it may be formed of any appropriate material which has the requisite strength without regard to surface finish.

Still other advantages adhere in the depicted construction. For instance, in the manufacture of prefabricated jamb assemblies it may be advantageous to assemble the jamb plate, core and sheathing to form a complete assembly before shipping. With such an approach, the presence of the jamb plate may serve to aid in the engagement of the sheathing and core; or a common nail or screw may be used to engage the jamb plate, core and sheath in one operation.

Figure 9:
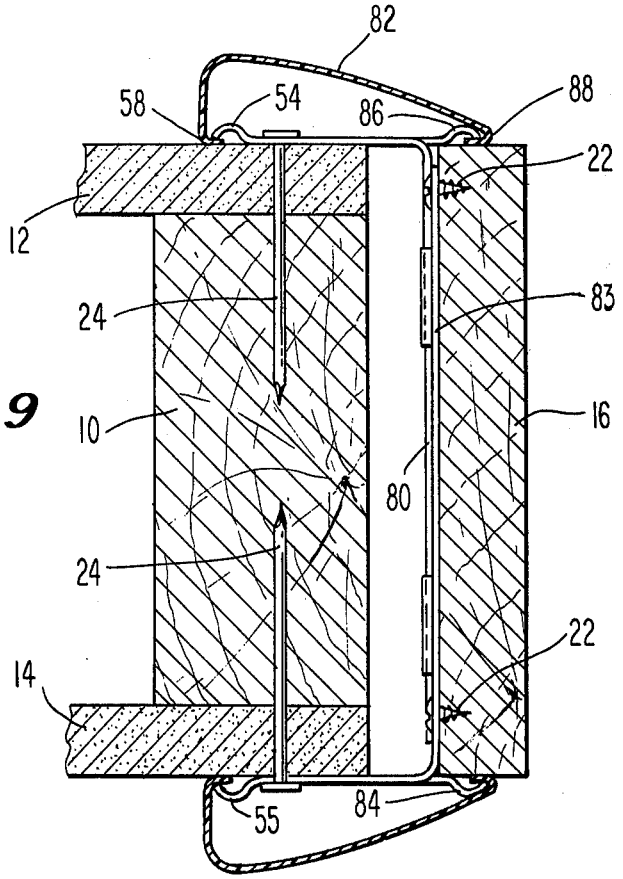
FIG. 9 is a cross-section diagram of jamb construction showing another embodiment of the invention.

FIG. 9 shows another embodiment of the inventive jamb mounting assembly, and illustrates alternative means for securing a molding in place. A jamb plate 83 is secured to the rear face of the jamb 16 by screws 22. Slide plate 80 is telescopingly receiving in apertures defined by the raised portions of jamb plate 78 in a manner which has been heretofore described. The opposed second legs of the jamb and slide plates are secured flush against wall surfaces 12, 14 by nails 24 which are driven into stud 10. As was the case with respect to the embodiment of FIG. 5, the extremities of the opposed legs of the slide and jamb plates are provided with detents 54, 55 for receiving an inwardly-turned lip 58 which extends along one edge of a molding 82.

A table 84 is provided and extends parallel to the second leg of jamb plate 78, and past the apex formed by the first and second legs thereof. The tab comprises a detent formed in a manner similar to that of detents 58, 55. A similar tab 86 is provided on slide plate 80 and extends past the apex thereof to abut of jamb 16 in the manner shown. It will be appreciated by those skilled in the art that tabe 84 and 86 may easily be formed by striking them from that portion of the first legs of the jamb and slide plates respectively which lie near the right-angled bend thereof.

The edge of molding 82 which abuts jamb 16 is provided with an inwardly-turned second lip 88. In order to install molding 82 over the detents of the slide and jamb plates, one lip of the molding is forced under one of the detents thereof and the molding struck a sharp blow to force the opposing lip over the edge of the opposite, detent, whereby the latter lip snaps into place between the detent and the juxtaposed wall or jamb surface.

As was the case with the embodiment of FIG. 5, if only a few jamb plate mounting assemblies are utilized, it may be necessary to provide additional detents for engaging molding 82 consistently along its length and securing it flush against the wall and jamb surfaces. In this case, additional clips may be provided which are equivalent to those portions of the jamb and slide plates lying beyond the apex thereof from the first leg portions. In fact, such clips can easily be formed by severing the second leg portions of jamb or slide plates, although it will probably be found more economical to manufacture such clips separately.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. A jamb mounting assembly for securing a jamb in spaced relation to an edge member of a rough opening in a structure, comprising:

a slide plate including first and second legs disposed at substantially right angles to one another;

a jamb plate having first and second legs, said first leg comprising at least one raised element extending substantially transversely to said first leg and defining apertures at either side thereof for slidably receiving said second leg of said slide plate, said legs of said jamb plate being disposed at substantially right angles to one another;

the distal ends of said second legs of said slide plate and jamb plate having a substantially semicircular bend so that the extremities thereof face toward a plane generally coextensive with said second legs to form a detent; and an elongate molding adapted to extend over ones of said second legs and having an inwardly-turned lip thereof, said lip being substantially flat to extend substantially parallel to said second legs and being receivable beneath said detent means.

2. A jamb mouting assembly according to claim 1 further including a jamb provided with an elongate slot therein and wherein said elongate molding further comprises a second lip disposed substantially perpendicular to said first lip for penetrating the slot, said second lip further having a protrusion thereon for engaging the walls of said slot.

3. A jamb mounting assembly according to claim 2, further including an abutment formed upon said second lip to limit the penetration thereof into the slot.

4. A jamb mounting assembly according to claim 3, further including a retention clip comprising gripping means adapted to be wedgingly disposed in the slot with said second lip.

5. A jamb mounting assembly according to claim 4, wherein said retention clip is formed from a segment of sheet metal and comprises:

a central portion having upstanding teeth struck therefrom;

a bottom portion formed by an acute bend at the end of said central portion; and a flange at the top of said end of said central portion spaced from said lower portion and extending at substantially right angles to said central portion.

6. A jamb mounting assembly according to claim 1, further including a tab struck from said first legs of each of said slide plate and said jamb plate and bent up to extend parallel to said second legs of said slide plate and said jamb plate and curved in the manner of a semicircle to form a resilient detent which extends past the junction with the first legs thereof to lie upon an exposed edge of the jamb.

7. A jamb mounting assembly for securing a jamb in spaced relation to an edge member of a rough opening in the wall of a habitable structure, comprising:

a slide plate including first and second legs disposed at substantially right angles to one another and including a longitudinally-extending generally U-shaped vein indented substantially along the length of said first leg to form an elongate convex ridge of substantially constant height and extending along substantially half the length of said second leg and extending within a right-angled bent portion thereof for rigidifying said slide plate;

a jamb plate having first and second legs disposed at substantially right-angles to one another, and including a longitudinally-extending generally U-shaped vein indented substantially over the length of said first leg to form an elongate concave depression of substantially constant depth, the bottom of said depression substantially conforming to the curvature of said convex ridge for slidingly receiving the latter to locate said jamb plate transversely on said slide plate, said vein further extending at least half the length of said second leg and extending within a right-angled bent portion thereof for rigidifying said jamb plate;

means on said first leg of said jamb plate for encapturing and slidably receiving said first leg of said slide plate and comprising at least two raised elements struck from said first leg to retain said vein of said jamb plate in longitudinally-sliding registry with said vein of said slide plate;

both said first and said second legs of said slide and said jamb plate defining apertures therein to allow the passage of fastening means for rigidly attaching said plates to an adjacent structure.

8. A jamb mounting assembly according to claim 7, wherein said retainer members comprise upstanding, partially severed tabs extending from an integral with the slide plate at regions generally adjacent the locus of movement of said slide plate, and extending generally parallel to the surface of said first leg of said jamb plate and alongside said vein to form a portion of an enclosing channel for telescopically receiving said slide plate.

* * * * *

UNITED STATES PATENT OFFICE
CERTIFICATE OF CORRECTION

Patent No. 4,014,146 Dated March 29, 1977

Inventor(s) Paul S. DiMascio et al.

It is certified that error appears in the above-identified patent and that said Letters Patent are hereby corrected as shown below:

Col. 2, line 47, "jamp" should be --jamb--;
line 65, "assembled" should be --assembling--.

Col. 5, line 27, "shaped" should be --shape--;
line 59, "mountd" should be --mounted--.

Col. 6, line 5, "through" should be --thought--;
line 16, "mouting" should be --mounting--.

Col. 7, line 18, "wedge" should be --edge--;
line 21, "formly" should be --firmly--.

Col. 8, line 50, "receiving" should be --received--;
line 61, "table" should be --tab--;
line 68, "tabe" should be --tabs--.

UNITED STATES PATENT OFFICE

CERTIFICATE OF CORRECTION

Patent No. 4,014,146 Dated March 29, 1977

Inventor(s) Paul S. DiMascio et al.

It is certified that error appears in the above-identified patent and that said Letters Patent are hereby corrected as shown below:

Col. 9, line 10, there should be no comma after "opposite";

line 54, "thereof" should be --thereon--;

line 57, "mouting" should be --mounting--.

Signed and Sealed this second Day of August 1977

[SEAL]

*Attest:*

RUTH C. MASON
*Attesting Officer*

C. MARSHALL DANN
*Commissioner of Patents and Trademarks*